US007306400B1

(12) United States Patent
Brochu et al.

(10) Patent No.: US 7,306,400 B1
(45) Date of Patent: Dec. 11, 2007

(54) LEACHING CHAMBER HAVING DOSING PIPE HANGER

(75) Inventors: Ronald P. Brochu, Westbrook, CT (US); James J Burnes, Deep River, CT (US)

(73) Assignee: Infiltrator Systems, Inc, Old Saybrook, CT (US)

( * ) Notice: Subject to any disclaimer, the term of this patent is extended or adjusted under 35 U.S.C. 154(b) by 0 days.

(21) Appl. No.: 11/018,200

(22) Filed: Dec. 20, 2004

Related U.S. Application Data

(63) Continuation-in-part of application No. 10/677,938, filed on Oct. 1, 2003, now Pat. No. 7,189,027.

(51) Int. Cl.
*E02B 13/00* (2006.01)
*E21F 17/02* (2006.01)
*F16L 3/00* (2006.01)

(52) U.S. Cl. ..... 405/49; 248/58

(58) Field of Classification Search ..... 248/58, 248/60
See application file for complete search history.

(56) References Cited

U.S. PATENT DOCUMENTS 3,648,468 A * 3/1972 Bowers ..... 405/157
5,401,116 A 3/1995 Nichols et al. ..... 405/48
6,375,388 B1 4/2002 Zoeller et al. ..... 405/43

OTHER PUBLICATIONS

The Infiltrator Septic System Installation Instructions, Infiltrator Systems, Inc Brochure 4 Pages (1989).

* cited by examiner

*Primary Examiner*—Tara L. Mayo
(74) *Attorney, Agent, or Firm*—Steven M. McHugh; C. Nessler

(57) ABSTRACT

A molded plastic corrugated arch shape cross section leaching chamber, which is adapted for connection to a like chamber with a pivotable connection, has a hanger for a dosing pipe which is contained within the concavity of a peak corrugation of the end of a mating chamber.

5 Claims, 3 Drawing Sheets

LEACHING CHAMBER HAVING DOSING PIPE HANGER

This application is a continuation in part of U.S. patent application Ser. No. 10/677,938 "Corrugated Leaching Chamber" of Brochu et al., filed Oct. 1, 2003 now U.S. Pat. No. 7,189,027.

TECHNICAL FIELD

The present invention relates to thermoplastic leaching chambers for receiving and dispersing liquids in soil.

BACKGROUND

Arch shape cross section molded plastic leaching chambers have been on the market for some time. They are especially useful for receiving wastewater and percolating it into the soil. Quite often, chambers heretofore have been connected end to end as a level string of chambers, which is closed at each end by an endplate. Wastewater is typically introduced at one end of the string, and flows along the soil at the bottom of the chamber. As it does, the water flows both downwardly and through perforations in the sidewall, to percolate into the soil.

Sometimes need or regulations require use of means other than gravity to distribute water along the length of a chamber string. A dosing pipe, through which pressurized waste water is flowed, may be laid along the interior soil floor of the string. Another option is to run a dosing pipe along the exterior of the chamber, to discharge water into the chamber interior at selected points. A popular approach has been to run a dosing pipe along the top interior of the chambers, so that water is discharged from spaced apart ports along the length of the pipe. Sometimes the dosing pipe is made integral with the chamber. See U.S. Pat. No. 6,375,388 to Zoeller. However, an integral dosing pipe adversely affects nesting and shipping costs, and increases product line inventory and distribution cost.

It is preferable that a worker install a dosing pipe within the chamber in the field, when that type of installation is desired. Thus, means for doing that conveniently have been sought, to speed installation and keep labor costs down. A popular prior art approach is to fasten the pipe to the top of the chambers by passing hangers through holes in the chamber top, so the pipe is held in a sling. Typically, the lengthwise spacing of such holes has been what seems suitable, but for convenience holes are often put at the ends of the chambers, where they are easily accessed. However, when chambers have joints which permit pivoting, placing the hangers at the ends becomes a problem. If the worker has to reach inside the chamber to install a hanger, it is not only irritating, it slows installation.

SUMMARY

An object of the invention is to provide molded plastic leaching chambers which have pivotable joint connections with a way of hanging dosing pipes which is effective, economical and convenient to access.

In accord with the invention, a molded plastic corrugated arch shape cross section leaching chamber which can be pivotably connected to another like chamber has a first end which comprises a dome and a second end which is shaped to overlap the dome of a like chamber. The second end has a peak corrugation with an interior concavity which overlies the dome top surface where the dosing pipe hanger is fastened. The hanger, such as a familiar cable tie, is run through perforations which are suitably placed on the dome top so the hanger and its fastening means will underlie the peak concavity, regardless of the angle between the chambers.

In further accord with the invention, a wastewater distribution system is comprised of a multiplicity of arch shape cross section leaching chambers like those just described, and a dosing pipe runs along at least part of the length of the string at the top interior of the chambers.

The foregoing and other objects, features and advantages of the present invention will become more apparent from the following description of preferred embodiments and accompanying drawings.

DESCRIPTION

Figure 1:
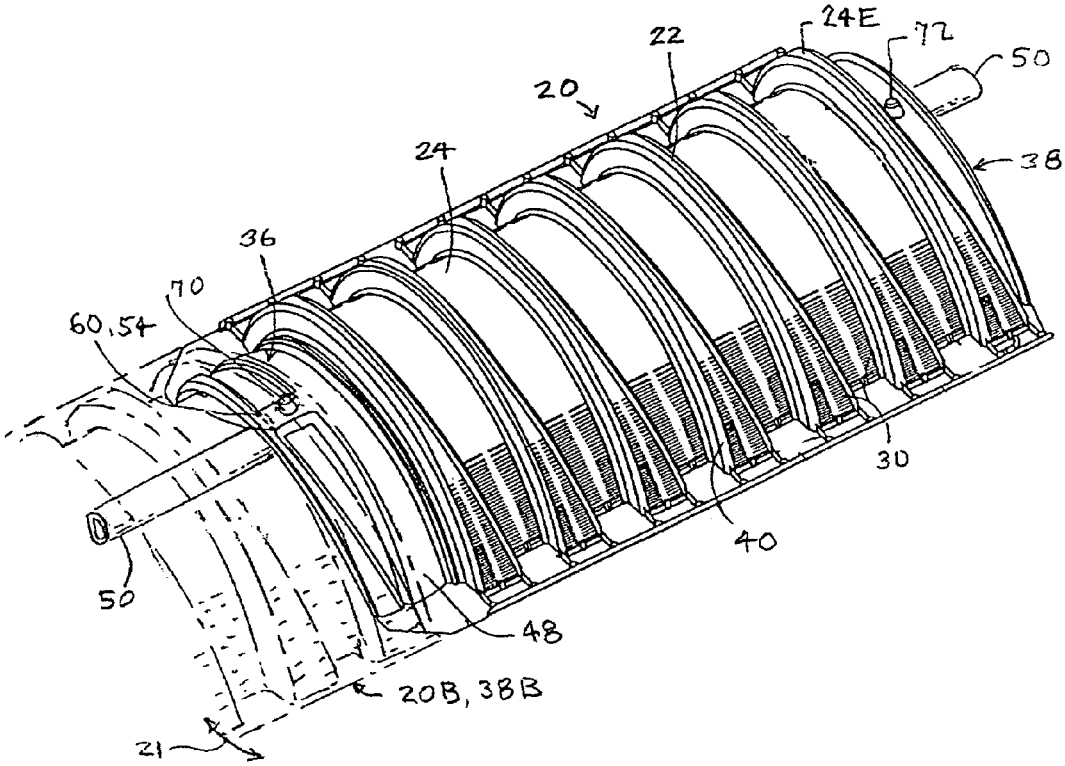
FIG. 1 is an isometric view of a leaching chamber having a dosing pipe, connected to a like chamber shown in phantom.

FIG. 1 shows a leaching chamber 20. It is more fully the parent application herein and in U.S. patent application Ser. No. 10/677,772 "Leaching Chamber with Inward Flaring Sidewall Perforations" of Swistak et al. The disclosures of the foregoing applications are hereby incorporated by reference. Chambers embodying features shown in the patents are sold commercially as Infiltrator® Quick4™ chambers. A chamber embodiment is made of injection molded polypropylene, is 34 inch wide at the base, about 12-15 inch maximum height, and about 52 inch long. When many like chambers are joined together, each chamber adds about 48 inch in length to a string of chambers.

Chamber 20 has corrugations which comprise peaks 22 and valleys 24 running along the curve of the arch shape cross section, which is preferably a continuous semi-elliptical curve, to connect the opposing side feet 26. The feet form the base of the chamber. The chamber first end 36 comprises a partial surface-of-revolution dome 48. The opposing second end 38 of an identical chamber can be overlaid on the first end, so male molded pin 70 is enveloped by female molded pin 72. A joint is formed between the chambers, which allows horizontal plane pivoting of the chambers about the pins at the time or installation, as indicated by arrow 21 in FIG. 1.

The second end 38B of chamber 20B, shown in phantom in FIG. 1, overlies the first end 36 of chamber 20. Dosing pipe 50, for instance a 1 to 2.5 inch diameter pipe, runs along the top of the interior of the chambers. As shown in the side cutaway view of FIG. 2, the pipe hangs from the top of the interior of the dome of end 36 by means of hanger 52 which passes through perforations 60 in the dome. Preferably the hanger is a familiar plastic (nylon) cable tie, which comprises a serrated surface band; to fasten the band in place, the free end of the band passes through an integral head 54 at the other end of the band. The head has a deflectable tang which prevents withdrawal of the band.

Figure 2:
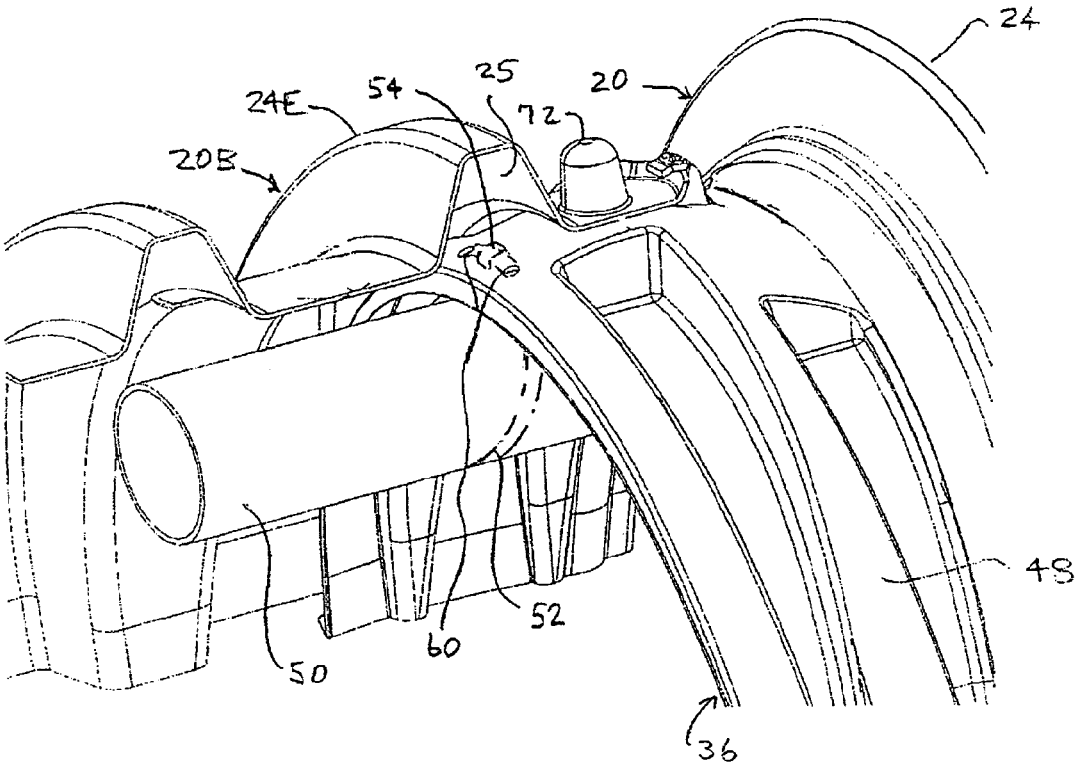
FIG. 2 is a partial cutaway side view of the joint between the chambers of FIG. 1.
Figure 4:
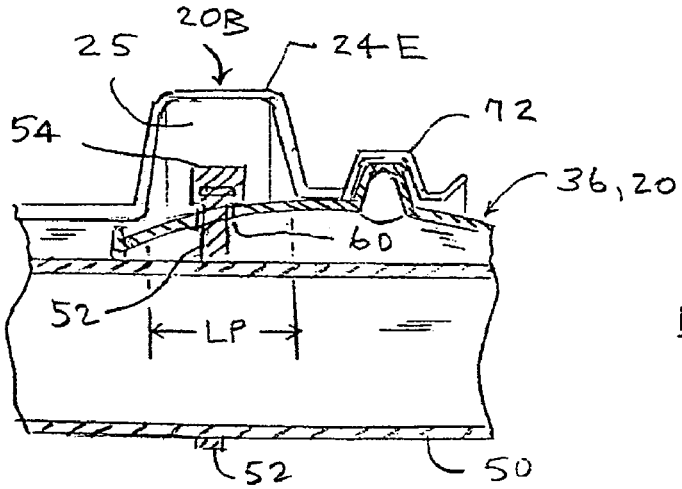
FIG. 4 is a partial vertical center plane cross section of the joint between the chambers.

In the invention, the head 54 of hanger 52, or a knot or other connection of a substitutional hanger, is positioned on the top of the dome at special location, namely so it is contained within the concavity 25 of peak corrugation 24E. The end 38 of chamber 20 comprises end peak corrugation 24E. As shown in FIGS. 2 and 4, peak 24E has an interior concavity 25, which overlies the dome top surface, when the joint is made, so that holes 60 and a hanger 54, when installed underlie the concavity.

Figure 3:
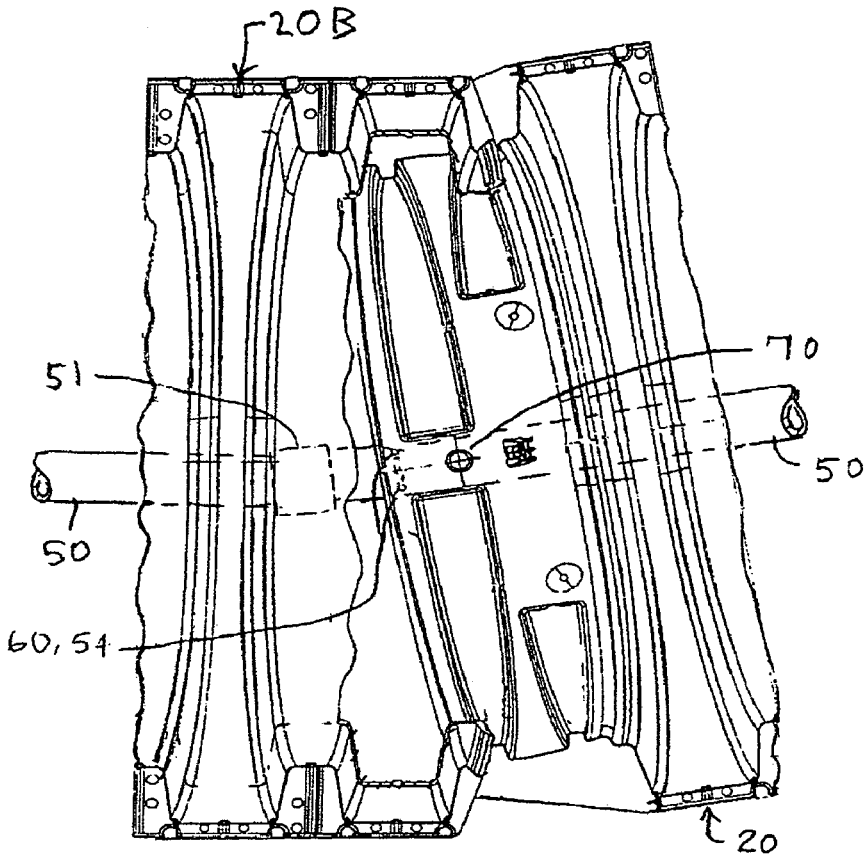
FIG. 3 is a partial cutaway top view of the joint between the chambers of FIG. 1, where the chambers have been angled.

The top view of FIG. 3 shows chambers 20, 20B moved to their maximum horizontal angle. The now-angled dosing pipes are connected by a common flexible rubber coupling 51. It will be appreciated that as the chambers pivot about pins 70, 72, typically through an angle of about plus or minus ten degrees from parallel, there will be a small amount of longitudinal movement of the peak corrugation concavity along the surface of the dome. The length dimension LP of the concavity is sufficient, relative to the size of the typical hanger, so that the hanger head easily stays contained within the concavity, and pivoting is not inhibited. For example, a typical hanger has a band of about ¼ inch wide, the holes are slightly larger, and the hanger head is about ⅜ inch square. In comparison, the dimension LP is about 2 inch.

Since the holes 60 are near the end of the chamber, within an inch or less, they are easily accessed, The dosing pipe can be hung quickly and easily from the dome end of the chamber, just prior to overlapping the chamber dome end with the end of the next chamber of the string.

Although this invention has been shown and described with respect to a preferred embodiment, it will be understood by those skilled in this art that various changes in form and detail thereof may be made without departing from the spirit and scope of the claimed invention.

We claim:

1. A molded plastic corrugated arch shape cross section leaching chamber which comprises:

a first chamber end having a dome shaped surface;

an opposing second chamber end, shaped to overlap the dome of a like chamber to form a pivotable joint between the chambers to allow the chambers to rotate in the horizontal plane relative to each other, the second end comprising a peak corrugation having an interior concavity which overlies the dome top surface when chambers are joined together; and means for hanging a dosing pipe from the interior top of the chamber, the means being positioned on the dome shaped surface so the means is positioned under said peak corrugation to be disposed within the interior concavity.

2. A molded plastic corrugated arch shape cross section leaching chamber which comprises:

a first chamber end having a dome shaped surface;

an opposing second chamber end, shaped to overlap the dome of a like chamber to form a pivotable joint between the chambers, the second end comprising a peak corrugation having an interior concavity which overlies the dome top surface when chambers are joined together; and means for hanging a dosing pipe from the interior top of the chamber, the means being positioned on the dome shaped surface so the means is positioned under said peak corrugation to be disposed within the interior concavity, wherein the means comprises perforations in the dome shaped surface through which portions of a hanger may pass, such that a portion of the hanger is disposed within the interior concavity to allow the opposing second chamber end and the dome of a like chamber to unobstructively pivot relative to each other when the opposing second chamber end and the dome of a like chamber are pivotably joined.

3. A wastewater distribution system comprising:

a multiplicity of arch shape cross section leaching chambers connected together at joints which enable pivoting between connected chambers, to form a chamber string;

a dosing pipe, for distributing wastewater, running along at least part of the length of the chamber string, at the top interiors of the chamber; wherein each chamber has a first end comprising a dome shaped surface;

an opposing second chamber end, shaped to overlie the dome of a like chamber to form a pivotable joint between the chambers to allow the chambers to rotate in the horizontal plane relative to each other, so that the joined together chambers may pivot through a horizontal angle relative to each other, the second end comprising an end peak corrugation having a top interior concavity which overlies a top portion of the dome shaped surface when two chambers joined together; and, means for hanging the dosing pipe within the interior top of the chamber, the means being positioned on the dome shaped surface so the means is positioned under said peak corrugation to be disposed within the interior concavity.

4. The system of claim 3, wherein the means of hanging comprises a tie which is fastened together at a head, wherein the head is disposed on the top of the dome shaped surface to be within said interior concavity.

5. A wastewater distribution system comprising:

a multiplicity of arch shape cross section leaching chambers connected together at joints which enable pivoting between connected chambers, to form a chamber string;

a dosing pipe, for distributing wastewater, running along at least part of the length of the chamber string, at the top interiors of the chamber; wherein each chamber has a first end comprising a dome shaped surface;

an opposing second chamber end, shaped to overlie the dome of a like chamber to form a pivotable joint between the chambers, so that the joined together chambers may pivot through a horizontal angle relative to each other, the second end comprising an end peak corrugation having a top interior concavity which overlies a top portion of the dome shaped surface when two chambers joined together; and, means for hanging the dosing pipe within the interior top of the chamber, the means being positioned on the dome shaped surface so the means is positioned under said peak corrugation to be disposed within the interior concavity, wherein the means for hanging comprises a tie which passes through the perforations in the dome shaped surface and fastens together at a hanger head within said concavity, wherein the head is disposed on the top of the dome shaped surface to be within said interior concavity.

* * * * *